United States Patent [19]

Ellenberger

[11] 3,932,829

[45] Jan. 13, 1976

[54] EXCESS CURRENT SWITCH

[75] Inventor: Jakob Ellenberger, Altdorf near Nurnberg, Germany

[73] Assignee: Ellenberger & Poensgen GmbH, Altdorf near Nurnberg, Germany

[22] Filed: Oct. 11, 1974

[21] Appl. No.: 514,281

[30] Foreign Application Priority Data

Oct. 25, 1973 Germany ..... 2353415

[52] U.S. Cl. ..... 337/49; 337/75; 337/77

[51] Int. Cl.[2] ..... H01H 71/16

[58] Field of Search ..... 337/49, 75, 77, 100, 102, 337/105

[56] References Cited

UNITED STATES PATENTS 2,247,194 6/1941 Frank et al. ..... 337/75

2,247,195 6/1941 Frank et al. ..... 337/75 X 3,873,955 3/1975 Bauer ..... 337/75 X

*Primary Examiner*—G. Harris

*Attorney, Agent, or Firm*—Spencer & Kaye

[57] ABSTRACT

This invention relates to an excess current switch. Such a switch includes a housing, a contact bridge, a bimetal strip for providing a thermal trip, switch actuating means and a slide bar. These components are arranged in a simple and space saving manner to allow the switch to be used as an ON/OFF switch which retain the characteristics of instantaneous switching ON and OFF and trip free release.

8 Claims, 5 Drawing Figures

EXCESS CURRENT SWITCH

The invention relates to an excess current switch, and more especially to such a switch having a bimetal strip for thermal trip purposes.

Excess current switch which has the advantage of having instantaneous switching ON, instantaneous switching OFF and trip-free release facilities are known. In one form of known switch a slide bar is formed by a connecting bridge which is rigidly connected, via a switching rod, with a switch-ON push button. A switch-OFF push button is provided for manually switching the known excess current switch OFF.

According to the present invention there is provided an excess current switch comprising a housing, a contact bridge, a bimetal strip for providing a thermal trip, switch actuating means movable between an ON position and an OFF position, and a slide bar, the bimetal strip including a retaining member for retaining the contact bridge in a first position which represents the switched ON condition of the switch, the slide bar being adapted to be guided in the housing and supporting a spring which biases the contact bridge so that when the contact bridge is released by the retaining member it is moved under the bias of the spring to a second position which represents the switched OFF condition of the switch, the contact bridge including a stop which is adapted to be engaged by the slide bar and brought into engagement with the retaining member of the bimetal strip during a switching ON operation, the actuating means being coupled to the slide bar and being pivotally mounted about an axis which is perpendicular to the direction of movement of the slide bar, the slide bar including a protuberance adapted to engage a stop on the bimetal strip during a switching OFF movement of the actuating means whereby the retaining member of the bimetal strip is disengaged from the contact bridge.

The present excess current switch can be selectively switched ON or OFF by suitable actuation of the actuating means. Since the slide bar is directly coupled with the actuating means a space-saving design of the excess current switch is thereby made possible.

For the purpose of guiding the slide bar, the slide bar has a respective flange at oppositely situated sides thereof, which flanges engage into guide grooves of the switching housing. One of the flanges may have a cut out portion into which an arm of the actuating means engages with a spherically shaped end. A simple coupling of the actuating means with the slide bar is thereby obtained.

The actuating means may either be formed as rocker lever or as toggle lever. In one form in which the actuating means is formed as a rocker lever, the actuating member is provided with a rocker member having a surface adapted to engage a corresponding surface of the actuating means in the region of its pivotable axis, the rocker further including two resiliently yieldable retaining protuberances which are adapted to engage corresponding projections on the actuating means whereby the rocker member can be snap fitted onto the actuating means.

In order to simplify manufacture the contact bridge is formed as an angled lever which is pivotably and displaceably mounted in a recess of rectangular cross-section in the switch housing. For the purpose of further simplification of manufacture the slide bar with the protuberance and the flanges is made as a single piece of plastics material.

In a further modification one arm of the angled lever is provided with a free end which is bent over to form the stop of the contact bridge.

Illustrative embodiments of the invention will now be described with reference to the accompanying drawings, in which.

Figure 1:
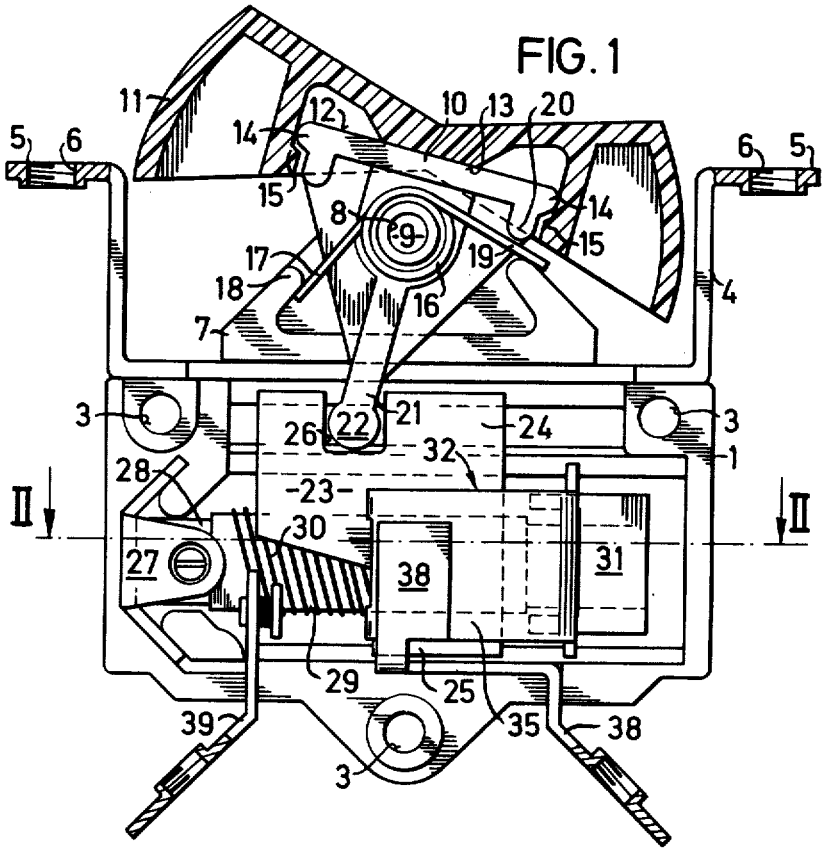
FIG. 1 shows in cross-section one form of the present excess current switch which is open in its switched ON position.
Figure 3:
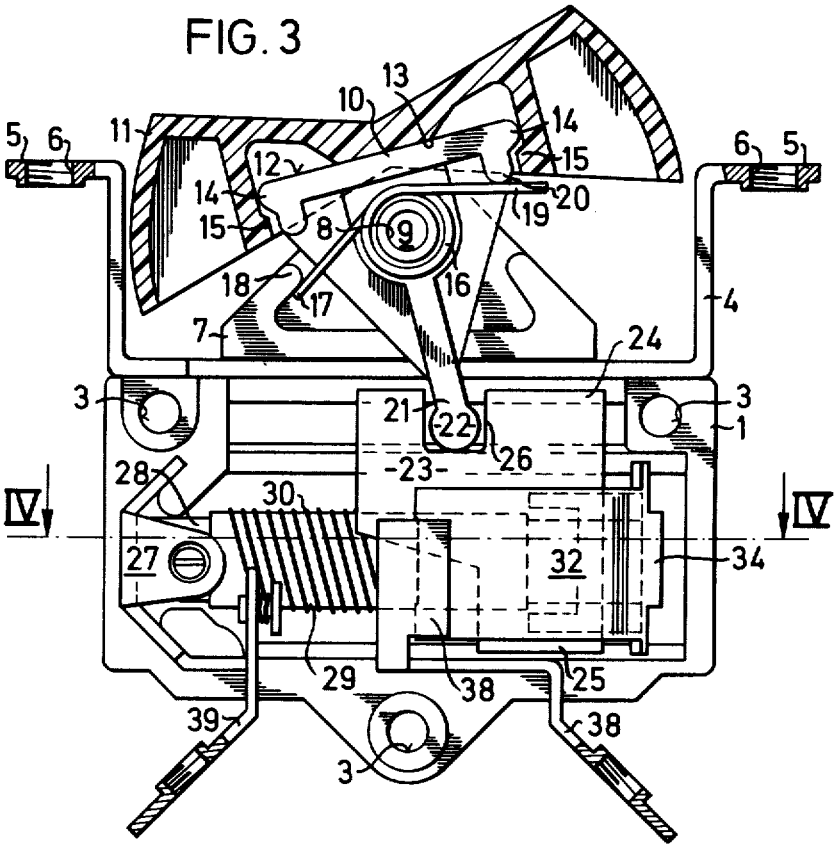
FIG. 3 shows a view similar to FIG. 1 of the excess current switch in its switched OFF position.

Referring now to the drawings, there is shown an excess current switch having a housing consisting of two housing halves 1 and 2 made of plastics material which are rigidly connected to each other, preferably by means of hollow rivets engaging into the bores 3 of both housing halves 1 and 2. A sheet metal fixing bracket 4 having two fixing flanges 5 with suitable bores 6 is rigidly connected to the housing half 1. As shown in FIGS. 1 and 3 each housing half 1, 2 has an upwardly projecting, triangular flange 7 made in one piece therewith. The flange 7 has a bore 8 into which a pivot shaft 9 in the form of a pin is inserted. An actuating element 10 carries a rocker 11 which may consist of a thermoplastics synthetic material, for example. The actuating element is arranged so that a surface 12 thereof engages a corresponding surface 13 on the rocker 11. The actuating element 10 has two protuberances 14 which are engaged by corresponding resilient retaining projections 15 of the rocker 11. When the rocker 11 is positioned on the actuating element 10 the resilient retaining projections 15 engage behind the protuberances 14 of the actuating element 10. On the pivot shaft 9 there is further provided a torsion spring 16 having a first arm 17 which is supported by a projection 18 on the flange 7 and a second arm 19 which is supported by a projection 20 on the actuating element 10. The actuating element 10, which may also be made of a thermoplastics synthetic material, includes an arm 21 made in one piece with the actuating element and having an end portion 22 of spherical configuration.

A slide bar 23 made of insulating material is mounted between the two housing halves 1 and 2. The slide bar 23 is provided with flanges 24 and 25 which engage into corresponding guide grooves formed between the two housing halves 1, 2. The flange 24 includes a slot 26 into which the spherical end 22 of the arm 21 engages.

Figure 2:
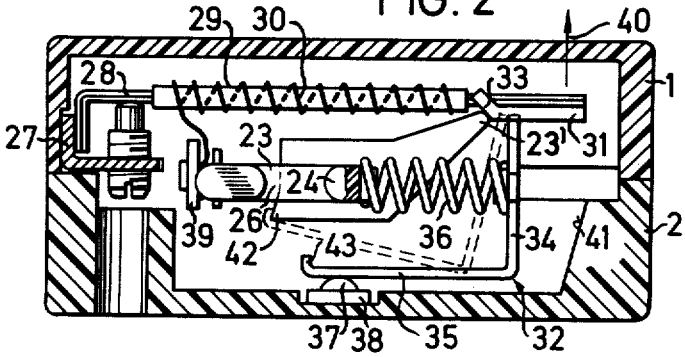
FIG. 2 shows a section taken along line II—II of FIG. 1.

In suitable recesses of the housing half 1 there is secured, by resilient clamping, a substantially V-shaped bimetal carrier 27 with which a bimetal strip 28 is rigidly connected, e.g. by welding. The bimetal strip 28 is provided with an insulating sleeve 29 onto which a heating coil 30 is wound. At its righthand end, as shown in FIG. 2, the bimetal strip 28 has a contact member 31 the median portion of which serves as retaining tab for a contact bridge 32 formed as an angled lever. At either side of this median portion the contact member 31 has two bent portions which constitute a stop or catch 33 and with which projections 23' of the slide bar 23 are adapted to co-operate. The contact bridge 32 has two arms 34 and 35. A compression spring 36 which is supported at the bottom of a suitable cavity of the slide bar 23 biases the arm 34. This compression spring 36 effects the contact pressure. In the ON position the arm 35 of the contact bridge 32 bears on a stationary contact member 37 which is connected to a terminal 38. One end of the heating winding 30 is connected to a further terminal 39 while the other end is directly connected to the bimetal strip 28. In the ON position as shown in FIGS. 1 and 2 electric current flows from the terminal 38 to the stationary contact member 37, via the contact bridge 32 to the contact member 31 of the bimetal strip 28, and thence via the heating winding 30 to the terminal 39. The circuit may also include the bimetal strip 28 so that the bimetal strip 28 is directly heated. The terminals 38, 39 may be formed as clamping connectors or as flat pin connectors.

Figure 4:
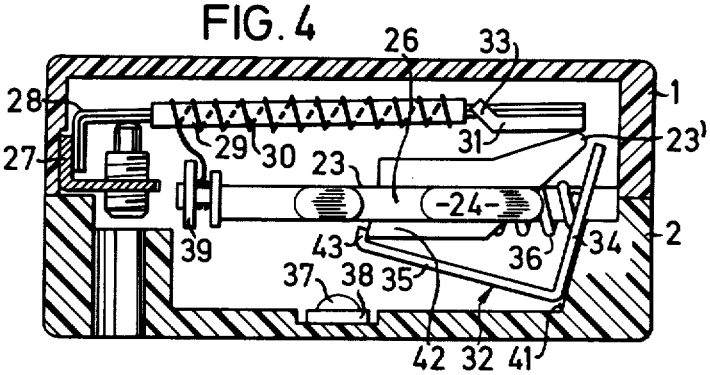
FIG. 4 shows a section taken along line IV—IV of FIG. 3.

When an excess current occurs the bimetal strip 28 is heated by the heating coil 30 and is bowed in the direction of the arrow 40 (FIG. 2) whereby the retaining tab of the contact member 31 releases the free end of the arm 34 of the contact bridge 32 and under the action of the compression spring 36 the contact bridge 32 is moved into the OFF position shown in FIG. 4 in which position the contact bridge contacts with its arm 34 a sloping surface 41 of both housing halves 1 and 2. In the OFF position of FIG. 4 an entrainment portion 42 of the slide bar 23 is within range of a perpendicularly bent portion of the arm 35 of the contact bridge 32 which bent portion serves as stop or catch 43. The perpendicularly bent portion thus forms a catch 43 for the portion 42 whereby the contact bridge 32 is entrained by the portion 42 during the switching ON movement. During this switching ON movement the free end of the arm 34 of the contact bridge 32 is engaged behind the retaining tab of the contact member 31 of the bimetal strip 28. When the rocker 11 is released after the switching ON movement, then the contact bridge 32, the arm 34 of which bears with its free end on the retaining tab of the contact member 31, is pivoted by the compression spring 36 using the retaining tab as a fulcrum. During this anticlockwise pivoting movement the perpendicularly bent portion of the arm 35 of the contact bridge 32, which portion serves as catch 43, is brought out of engagement with the entrainment portion 42 of the slide bar 23, so that the contact bridge 32 then abruptly, under the action of the compression spring 36, comes to contact with its arm 35 against the stationary contact piece 37.

Instantaneous switching ON is thereby obtained. Instantaneous switching OFF under the action of the compression spring 36 is obtained when upon the bimetal strip 28 bowing in the direction of the arrow 40 the retaining tab of the contact piece 31 releases the free end of the arm 34 of the contact bridge 32.

Such a trip also results when the slide bar 23 is constrained in the switching ON position of FIG. 2 by the arm 21 of the actuating element 10. Thus the excess current switch also exhibits trip-free release.

When the excess current switch is to be switched from its ON position to its OFF position, manually, by means of the rocker 11, then it is merely necessary to rock the rocker 11 anticlockwise from the FIG. 1 position to the FIG. 3 position. A displacement of the slide bar 23 to the right by the arm 21 results thereby. The protuberances 23' of the slide bar 23 then impinge on the bent portions of the contact piece 31 of the bimetal strip 28 which portions serve as stop or catch 33, whereby the bimetal strip 28 is so bowed in the direction of the arrow 40 that the retaining tab of the contact member 31 releases the free end of the arm 34 of the contact bridge and the contact bridge 32 is brought into the OFF position of FIG. 4 under the effect of the compression spring 36. Thus the excess current switch can also be used as ON and OFF switch.

Figure 5:
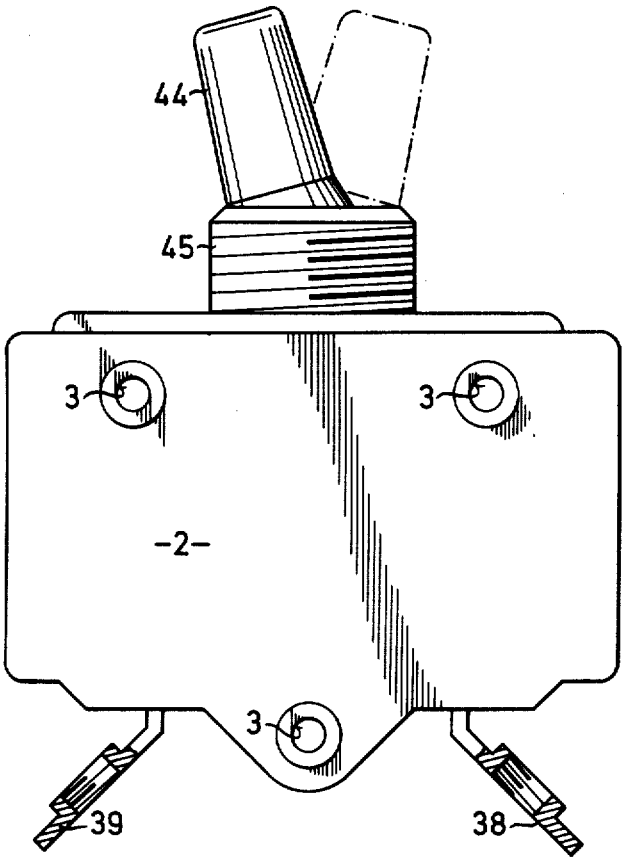
FIG. 5 shows a front elevation of another form of closed excess current switch having a toggle lever.

The excess current switch shown in FIG. 5 is similar in general construction to that shown in FIGS. 1 to 4. However, the switch of FIG. 5 has a toggle lever 44 by way of actuating element which is rigidly connected with the actuating element 10 or may be made in one piece with the latter.

The toggle lever 44 is mounted in a threaded sleeve 45 which is rigidly secured in the two housing halves 1, 2.

I claim:

1. An excess current switch comprising a housing, a contact bridge, a bimetal strip for providing a thermal trip, switch actuating means movable between an ON position and an OFF position, spring means and a slide bar, the bimetal strip including a retaining member and a stop, the retaining member being arranged for retaining the contact bridge in a first position which represents the switched ON condition of the switch, the slide bar being adapted to be guided in the housing and supporting the spring means which biases the contact bridge so that when the contact bridge is released by the retaining member it is moved under the bias of the spring to a second position which represents the switched OFF condition of the switch, the contact bridge including a stop, said stop being adapted to be engaged by the slide bar and brought into engagement with the retaining member of the bimetal strip during a switching ON operation, the actuating means being coupled to the slide bar and being pivotally mounted about an axis which is perpendicular to the direction of movement of the slide bar, the slide bar including a protuberance, said protuberance being adapted to engage said stop on the bimetal strip during a switching OFF movement of the actuating means whereby the retaining member of the bimetal strip is disengaged from the contact bridge.

2. A switch according to claim 1, in which the slide bar includes opposed flanges which are arranged to engage means defining guide grooves in the housing.

3. A switch according to claim 2, in which one of the flanges includes means defining a cut out portion and the actuating means includes an arm, one end of the arm engaging in the cut out portion to provide the coupling between the slide bar and actuating means.

4. A switch according to claim 2, in which the slide bar, its protuberances and flanges are made in one piece from a synthetic material.

5. A switch according to claim 1, in which the actuating means is provided with a rocker member.

6. A switch according to claim 5, in which the rocker member is provided with a surface, said surface being adapted to engage a corresponding surface of the actuating means in the region of its pivotable axis, the rocker further including two resiliently yieldable retaining protuberances, said protuberances being adapted to engage corresponding projections on the actuating means whereby the rocker member can be snap fitted onto the actuating means.

7. A switch according to claim 1, in which the contact bridge is formed as an angled lever which is pivotably and displaceably mounted in means defining a recess of rectangular cross-section in the housing.

8. A switch according to claim 7 in which one arm of the angled lever has a free end which is bent over to form the stop of the contact bridge.

* * * * *